US006840589B2

(12) United States Patent
Uri

(10) Patent No.: US 6,840,589 B2
(45) Date of Patent: Jan. 11, 2005

(54) TOWEL WARMER AND DRYER CABINET

(76) Inventor: Michaeldavid Uri, 779 Sylvia St., Ashland, OR (US) 97520

( * ) Notice: Subject to any disclaimer, the term of this patent is extended or adjusted under 35 U.S.C. 154(b) by 0 days.

(21) Appl. No.: 10/016,047

(22) Filed: Dec. 11, 2001

(65) Prior Publication Data

US 2002/0084730 A1 Jul. 4, 2002

Related U.S. Application Data

(60) Provisional application No. 60/254,519, filed on Dec. 11, 2000.

(51) Int. Cl.[7] ..... A47B 77/10

(52) U.S. Cl. ..... 312/228.1; 312/410

(58) Field of Search ..... 312/228.1, 410, 312/236, 300; 34/618, 619, 622; 219/385, 386, 520, 521

(56) References Cited

U.S. PATENT DOCUMENTS

| | | | | |
|---|---|---|---|---|
| 1,409,877 A | | 3/1922 | McNeill | |
| 1,934,125 A | * | 11/1933 | Hurt | 312/410 X |
| 1,946,386 A | * | 2/1934 | Buschman | 312/236 X |
| 2,225,762 A | * | 12/1940 | Barnsteiner | 312/410 X |
| 2,831,268 A | | 4/1958 | Cox | |
| 4,856,206 A | * | 8/1989 | Klein | 34/619 |
| 4,927,995 A | | 5/1990 | Lovett et al. | |
| 5,555,640 A | * | 9/1996 | Ou | 34/202 |
| 6,175,970 B1 | | 1/2001 | Pinciaro | |

FOREIGN PATENT DOCUMENTS

| | | | | |
|---|---|---|---|---|
| FR | 2332721 | * | 6/1977 | 312/410 |

* cited by examiner

*Primary Examiner*—James O. Hansen
(74) *Attorney, Agent, or Firm*—Olson & Olson

(57) ABSTRACT

A towel warmer and dryer cabinet includes a furniture style cabinet having an open front side and configured to contain a towel support rod assembly in which laterally spaced frame members support between them one or more towel support rods spaced apart for draping towels thereon to allow heated air to pass through them. The frame members are movable between a retracted storage position confined within the cabinet and an operative position extending forwardly through the open front side of the cabinet. A source of heated air provides a current of warmed air moving from within the cabinet through the open front end thereof and around towels draped over the support rods. A front panel is hung from the upper front side of the frame members for swinging movement to open and close the front side of the cabinet as the frame members are moved between the operative and storage positions. The frame members are mounted on the cabinet either for pivotal movement from adjacent the bottom of the open front end of the cabinet, or for horizontal, rectilinear movement adjacent the top of the open front side of the cabinet.

5 Claims, 5 Drawing Sheets

TOWEL WARMER AND DRYER CABINET

This application claims the benefit of Provisional patent application filed 11 Dec. 2000 under Ser. No. 60/254,519.

BACKGROUND OF THE INVENTION

This invention relates to towel warmers, and more particularly to a towel warmer and dryer integrated into a bathroom cabinet.

Towel warmer cabinets have been provided heretofore in a variety of configurations, either as free-standing units or built into a wall of a building. Typical of these are disclosed in U.S. Pat. Nos. 1,409,877; 2,831,268; 4,927,995; and 6,175,970. Such prior towel warmer cabinets are characterized by structures in which towels and the like are confined within a closed compartment through which ambient or heated air is passed to effect drying and warming. This mode of drying in a confined space is inefficient, and therefore requires more drying time and incurs added cost.

SUMMARY OF THE INVENTION

The towel warmer and dryer cabinet of this invention provides one or more support rods for suspending towels and like fabric materials, hereinafter included in the term "towels", freely therefrom and mounted for movement between a storage position retracted within a closed cabinet space and an operative position extending outwardly of the opened cabinet for exposure of towels to ambient or warmed air passing therethrough.

It is the principal objective of this invention to provide a towel warmer and dryer cabinet that overcomes the limitations and disadvantages of prior towel warmer cabinets.

Another objective of this invention is the provision of a towel warmer and dryer cabinet that is capable of being opened to expose the towels to room atmosphere for maximum efficiency of drying.

Still another objective of this invention is to provide a towel warmer and dryer cabinet which opens by pivoting a towel support outwardly from the bottom end to allow towels to hang freely downward for drying.

A further objective of this invention is the provision of a towel warmer and dryer cabinet which opens by moving a towel support horizontally outward through the front of the cabinet to allow towels to hang freely downward for drying.

A still further objective of this invention is the provision of a towel warmer and dryer cabinet which is open at the bottom for positioning over a room floor heat register for directing heated air current upward and outward through the open front side of the cabinet to towels suspended in front of the cabinet.

Another object of this invention is to provide a towel warmer and dryer cabinet in which a pivoted towel rod carrier has a back wall that serves to deflect ambient or warmed air outward to towels hanging from the supporting rod outwardly of the open front side of the cabinet.

A further objective of this invention is to provide a towel warmer and dryer cabinet in which a towel rod carrier supports a front cabinet panel pivotally at its upper end so as not to interfere with vertically hanging towels for drying and warming forwardly of the open front side of the cabinet.

A still further objective of this invention is to provide a towel warmer and dryer cabinet which serves additionally as a support for a bathroom lavatory bowl mounted on the top of the cabinet.

The foregoing and other objectives and advantages of this invention will appear from the following detailed description, taken in connection with the accompanying drawings of preferred embodiments.

DESCRIPTION OF THE PREFERRED EMBODIMENTS

Figure 1:
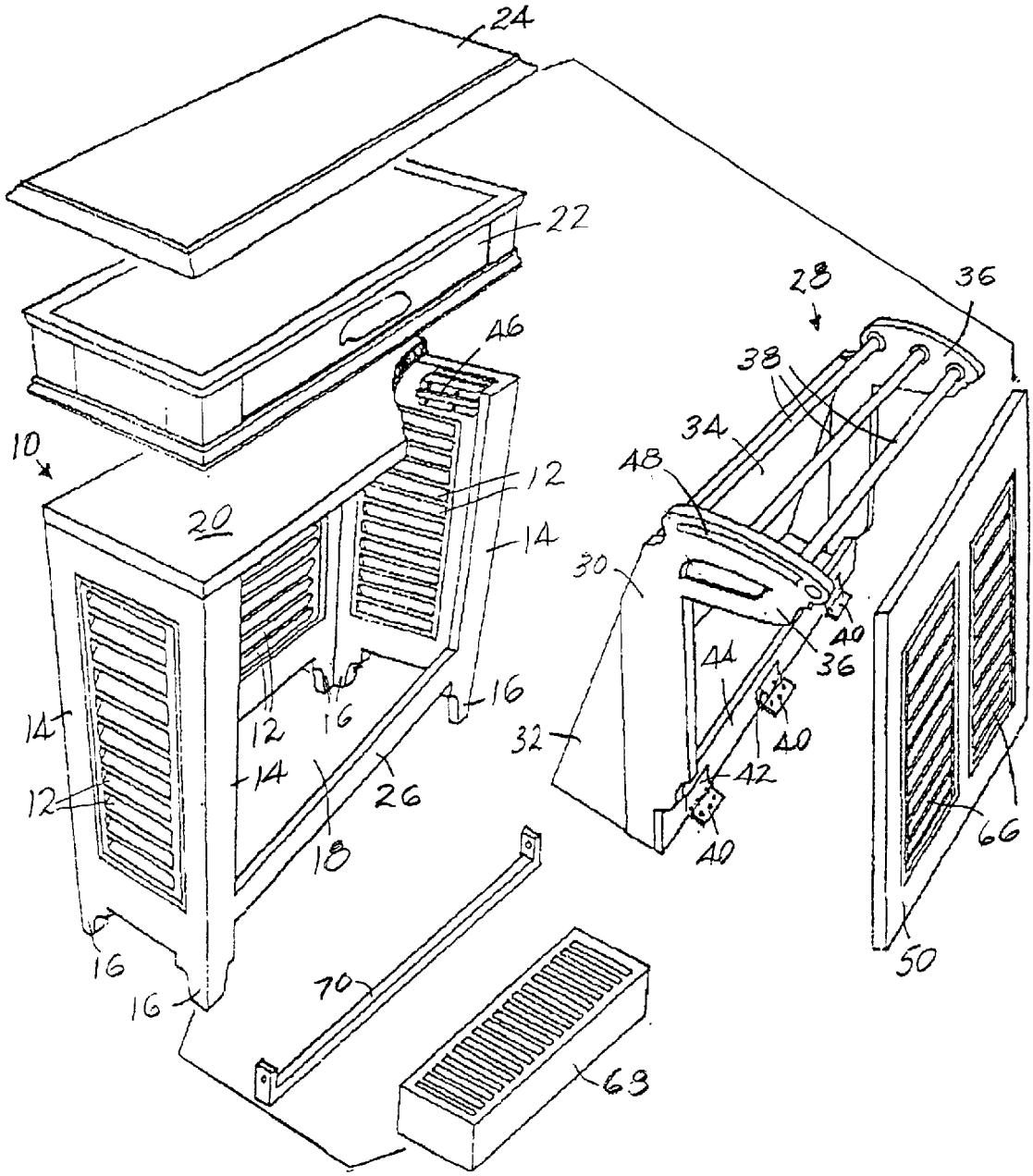
FIG. 1 is an exploded perspective view of a towel warmer and dryer cabinet embodying the features of this invention.

FIG. 1 illustrates, in exploded view, a towel warmer and dryer cabinet of this invention which includes a cabinet 10, preferably of furniture quality, provided with louvres 12 on the back and side walls for passage of air. The corner posts 14 terminate in feet 16 which space the open bottom 18 of the cabinet from the floor of a room. The open bottom allows the cabinet to be positioned over a floor register of a heating system. The top 20 supports a drawer component 22 which is overlaid with a decorative counter top 24.

The front corner posts 14 are reinforced by an interconnecting beam 26 which also supports a towel support frame 28. The frame 28 is formed of side walls 30 which include wedge members 32 supporting back wall 34 in a position sloping angularly forward from bottom to top. The upper ends of the side walls 30 support forwardly projecting extensions 36 which mount towel support rods 38. The rods span the space between the extensions and are spaced apart to support towels in a downwardly hanging arrangement for passage of air upward between them.

The frame 28 extends through the open front side of the cabinet 10 and is connected to the back side of beam 26 by hinge segments 40. The companion hinge segments 42 are secured to the front side of the frame member 44 connecting the bottom ends of the side walls 30 together. Thus, the frame 28 is pivotable about the axis of the hinges between a retracted, storage position within the cabinet and an operative position extending outwardly of the open front side of the cabinet. Movement of the frame is made quiet by felt pads 46 secured to the inner sides of the side walls of the cabinet and slidably engaged by metal plates 48 secured to the outer sides of the extensions 36.

Figure 2:
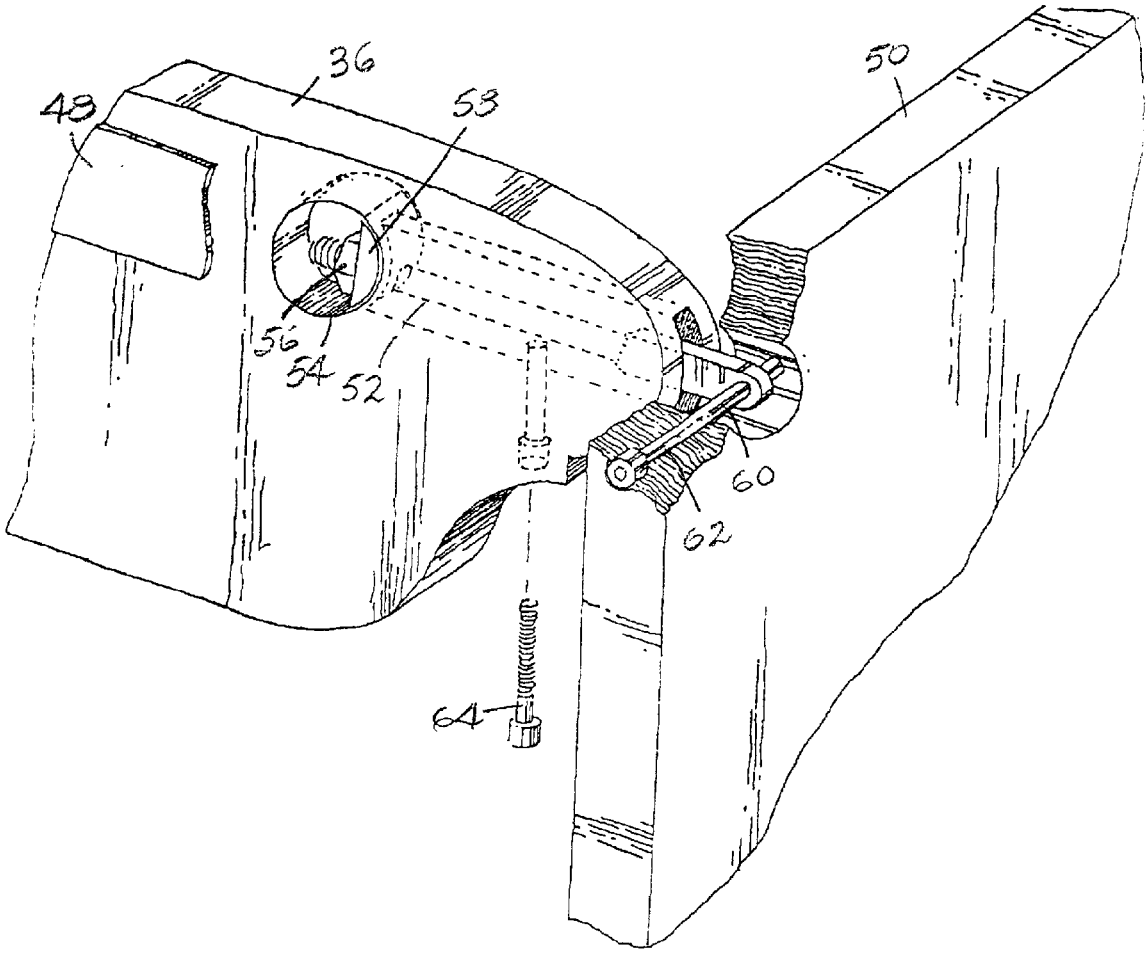
FIG. 2 is a fragmentary perspective view, on an enlarged scale, showing a pivot support for the front panel of the cabinet of FIG. 1.
Figure 4:
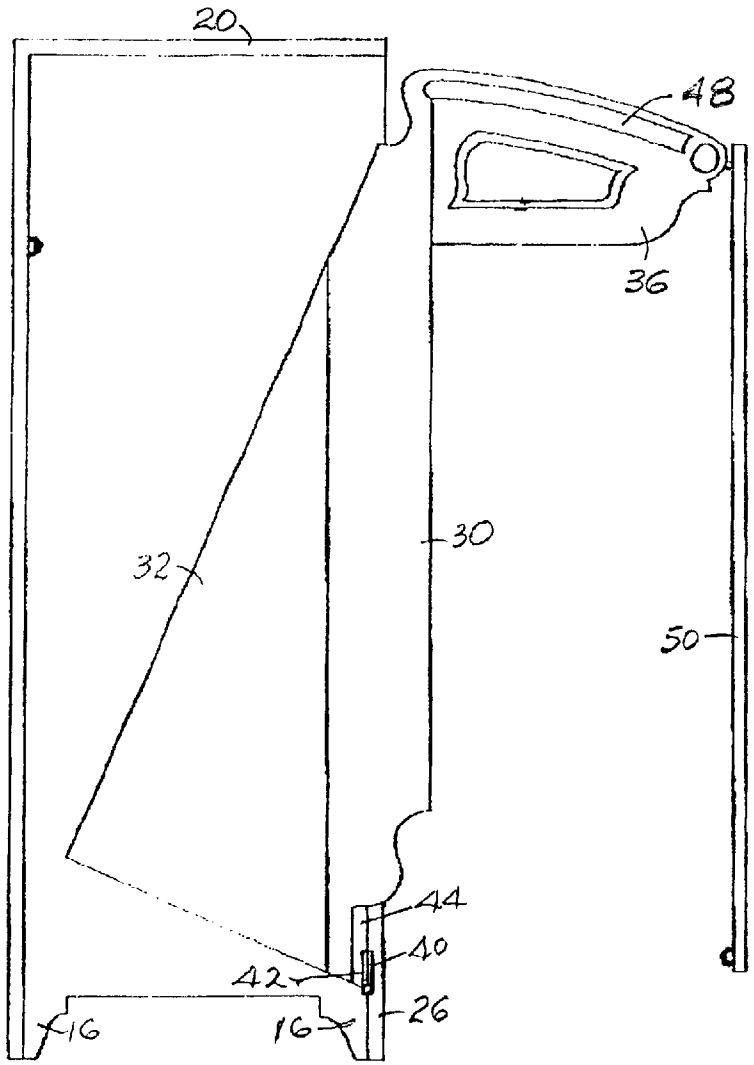
FIGS. 3 and 4 are side elevations of the cabinet of FIG. 1 with the left side wall of the cabinet removed to show the towel rod support frame in storage and operative positions, respectively.
Figure 3:
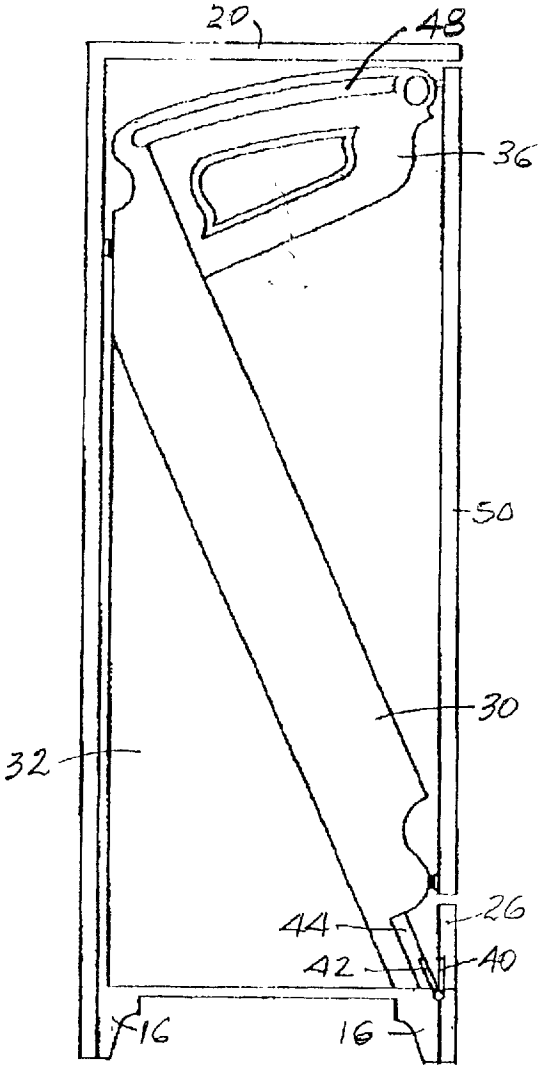

A front panel 50 is hung from the front end of the extensions 36 by adjustable pivots shown in FIG. 2. An elongated arm 52 extends through an opening in the forward portion of each extension 36. The rearward end of each arm is exposed through a transverse opening 54 in the extension and is threaded to receive an adjustment nut 56 which bears against a washer 58 having an arcuate surface conforming to and abutting the surface of the opening 54. The front end of the arm 52 projects forwardly of the extension 36 and the flattened end portion is provided with a transverse bore for reception of a pivot shaft 60 extended removably in an opening 62 in the corresponding side of the front panel 50. The pivot shaft supports the front panel at its upper end for free swinging movement about the axis of the pivot shaft. The front panel thus maintains a vertical position as the frame 28 is moved between retracted and extended positions. Adjustment of the arms 52 by nut 56 allows the front panel to be aligned properly within the front opening of the cabinet, as shown in FIG. 3. The pivoted front panel remains in vertical position in the extended, operative position of FIG. 4, so as not to interfere with towels hanging from the support rods.

Axial movement of the arm 52 is afforded by the nut 56 to allow adjustment of the position of the front panel 50 relative to the front end of the extensions 36. The opening in which the arm 52 is received is elongated vertically to allow vertical movement of the arm upwardly from an adjusted lower position established by the set screw 64. Movement upward from the lowered position allows the front panel 50 a limited degree of upward movement.

The front panel preferably is provided with louvres 66 (FIG. 1) to promote passage of ambient or heated air outwardly through the towels. If desired, a heater unit 68, preferably provided with a fan to assist movement of heated air, may be mounted in the cabinet below the frame 28, as by support bar 70 secured at its ends to the side walls of the cabinet 10. In such event the open bottom 18 may be closed by a bottom wall.

In use, the frame 28 is pulled outwardly through the open front side of the cabinet to the extended, operative position, by grasping the front panel 50 or a hand pull secured to the front panel, and towels are draped over one or more of the support rods from which they hang vertically downward by gravity. Whether the cabinet is positioned over a floor register of a conventional forced air furnace system or is provided with a heater unit 68, a current of heated air is moved upward into the cabinet 10 and deflected forwardly by the sloping back wall 34, through the open front of the cabinet and thence around the towels hanging from the rods 38. When warmed and dried, the towels may be removed for use or retained on the rods. The towel support frame assembly 28 then may be pivoted about the axis of the hinges 40, 42 to the retracted, storage position. When dry towels are to be warmed, the frame assembly may be retained in the retracted, storage position.

Figure 5:
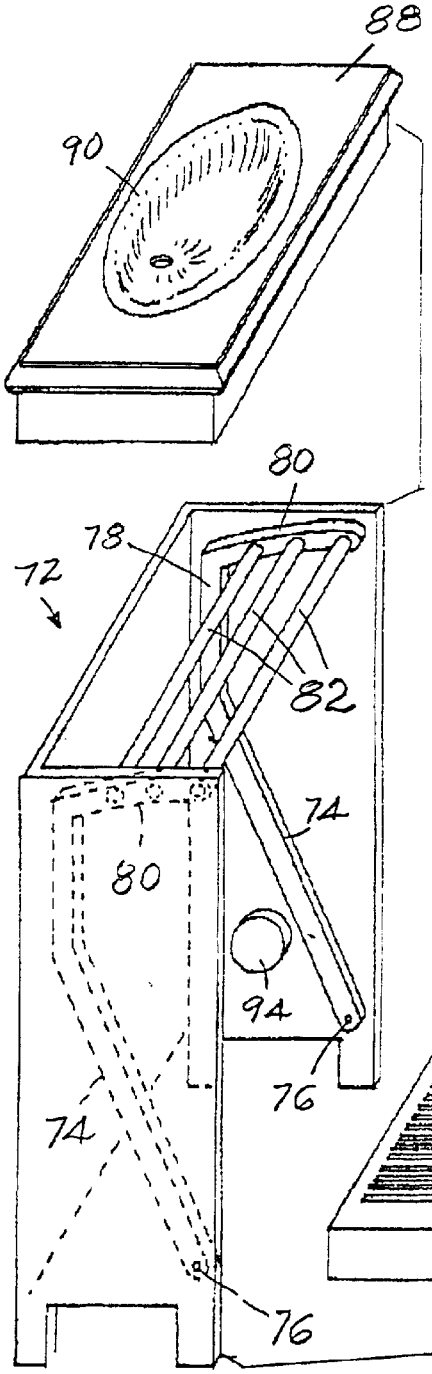
FIG. 5 is an exploded perspective view of a second configuration of towel warmer and dryer cabinet embodying the features of this invention, the towel support rod assembly being shown in retracted position and the heater assembly detached.
Figure 6:
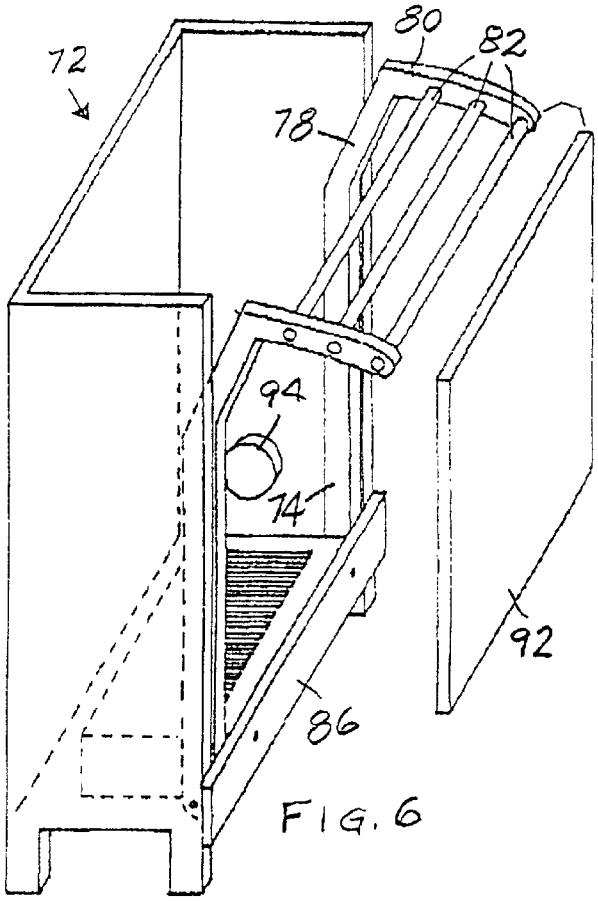
FIG. 6 is an exploded perspective view of the towel warmer and dryer cabinet of FIG. 5 with the towel support rod assembly shown in extended operative position and the heater assembly installed in the cabinet.

The embodiment illustrated in FIGS. 5 and 6 provides the cabinet 72 with a towel support frame formed of a pair of laterally spaced elongated side bar members 74 secured at their bottom ends to the side walls of the cabinet by pivot screws 76. The members 74 are bent angularly intermediate their ends to form an abutment section 78 for engaging the back wall of the cabinet when moved to the retracted, storage position. The upper end portion 80 of the bar members are bent forwardly from the intermediate section 78 to provide mounting bases for towel support rods 82 extending between them. The section 78 also allows the upper end portion 80 to be extended further forward of the open front side of the cabinet, facilitating the hanging of towels on the rods 82 and affording greater air movement through the towels.

The bottom of the cabinet 72 is open, as in the previously described embodiment, and is provided with a heater unit 84. Accordingly, a bottom wall may be provided to close the bottom end of the cabinet. As illustrated, the heater unit is mounted adjacent the open bottom of the cabinet 72 by plate 86 secured to the front edge of the side walls of the cabinet.

In the embodiment of FIGS. 5 and 6 the top of the cabinet 72 is closed by a counter top 88 which mounts a bathroom lavatory bowl 90. The drain pipe for the bowl may be extended laterally to an inconspicuous back inside corner of the cabinet and thence downward through the floor of the bathroom. The heater unit is configured to provide the space for the drain pipe.

The embodiment of FIGS. 5 and 6 also includes a front panel 92 (FIG. 6) suspended from the front ends of the rod supporting upper end portions 80, in the manner illustrated in FIG. 2. Additionally, a packet 94 of scented oil may be secured to the inner side of one or both side walls of the cabinet 72, to give a pleasing aroma to the heated air.

In use for drying, the towel support rod assembly is moved to the extended, operative position of FIG. 6 by pulling outwardly on the front panel 92, or on a drawer pull on the panel, until the side bar members 74 abut the plate 86 (FIG. 6). The heater and fan are activated to move heated and scented air outwardly through the towels.

Figure 7:
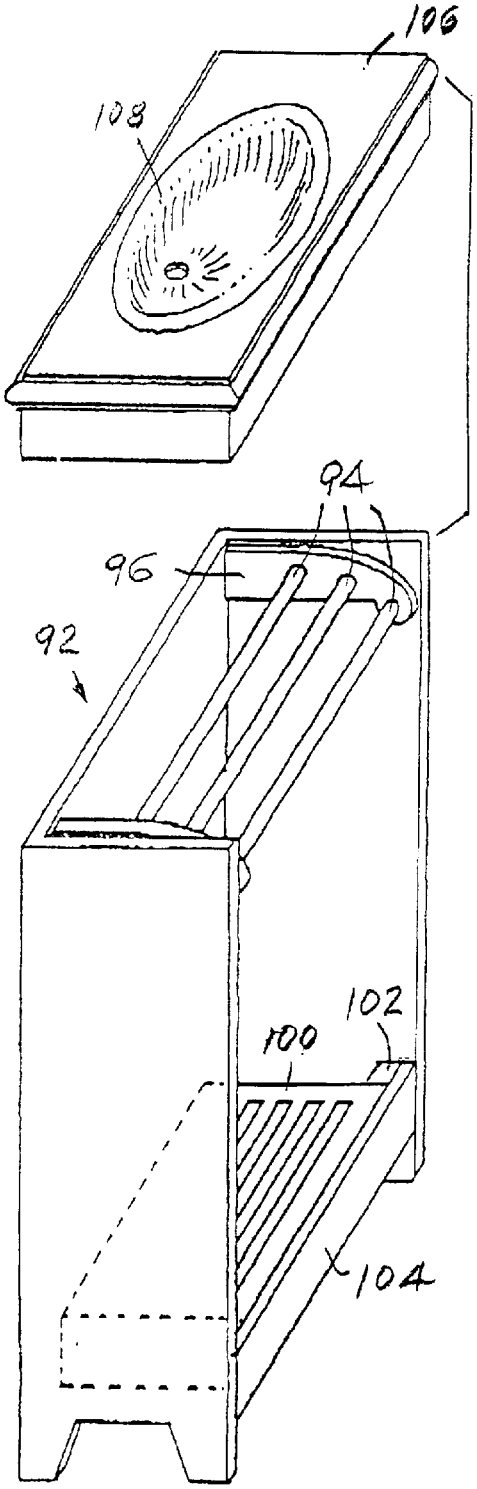
FIG. 7 is an exploded perspective view of a third configuration of towel warmer and dryer cabinet embodying the features of this invention, the towel support rod assembly being shown in the retracted, storage position.
Figure 8:
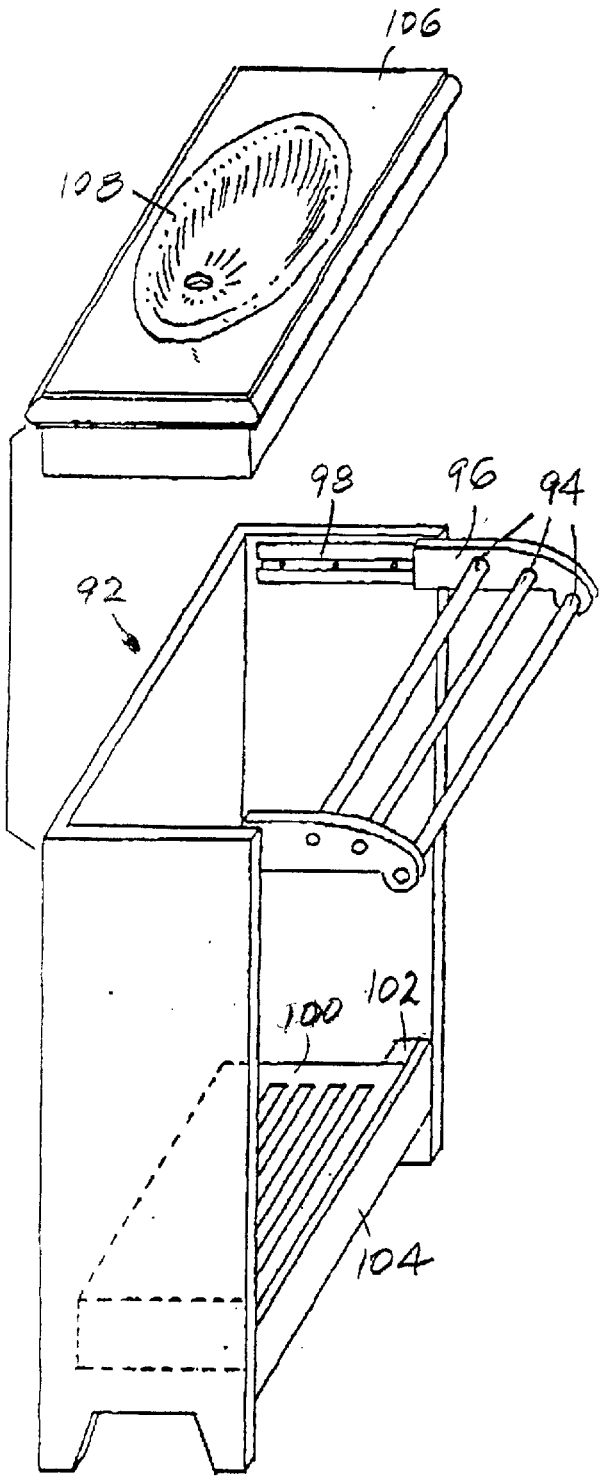
FIG. 8 is an exploded perspective view of the towel warmer and dryer cabinet of FIG. 7 with the towel support rod assembly shown in extended, operative position.

The embodiment shown in FIGS. 7 and 8 differs from the previous embodiment in the structure of the towel support rod assembly. Whereas in FIGS. 5 and 6 the support rod assembly is mounted pivotally on the cabinet 72, the support rod assembly in FIGS. 7 and 8 is mounted for horizontal, rectilinear movement relative to the cabinet 92. Thus, the towel rods 94 are secured at their opposite ends to support members 96 which are mounted slidably on track members 98 secured to the cabinet side walls, for rectilinear movement between the retracted, storage position of FIG. 7 within the cabinet 92 and the operative position of FIG. 8 extending forwardly of the open front side of the cabinet. This embodiment also includes a heater unit 100 secured within the cabinet by anchor blocks 102 on the cabinet side walls to which the projecting ends of plate 104 are secured, as by screws. This embodiment also includes a counter top 106 and lavatory bowl 108, as in FIGS. 5 and 6. A front panel, such as 50 or 92, may be provided if desired. Alternatively, a decorative towel may be draped over the front towel rod 82 to serve as a front panel. The front towel rod also is used as a hand pull.

It will be apparent to those skilled in the art that various changes may be made in the size, shape, number, type and arrangement of parts described hereinbefore. For example, a source of heated air may be omitted or turned off, and a fan used to move ambient air through the towels. The cabinet may be configured with a bottom wall arranged to rest directly on a floor. The rod support may be arranged to allow the forwardmost towel rod to be used as a door pull. The cabinet may be configured for installation in a wall of a room, such as a bathroom, or it may be designed for hanging or other form of mounting on the outer surface of a wall. The sloping back wall 34 of FIG. 1 may be incorporated into the embodiments of FIGS. 5 and 6 and FIGS. 7 and 8. Further, it is to be understood that the cabinet configurations illustrated may be used for heating towels when in the closed position, and for drying towels when in the open position. These and other changes may be made without departing from the spirit of this invention and the scope of the appended claims.

I claim:

1. A towel warmer and dryer cabinet, comprising a) a hollow cabinet having an open front side and laterally spaced side walls, b) a pair of towel rod support members one positioned adjacent each of the lateral side walls of the cabinet for supporting therebetween a towel support rod adjacent an upper end of the open front side of said cabinet, c) at least one towel support rod extending between and supported by said towel rod support members adjacent the upper end of the open front side of said cabinet for hanging a towel vertically downward from said rod toward a bottom of said cabinet, d) securing means integrally connecting said cabinet and said towel rod support members together and configured to enable movement of said at least one towel support rod through said open front side of the cabinet between a position retracted within the cabinet and a position extended forwardly of said open front side of the cabinet while maintaining the at least one towel support rod adjacent the upper end of the cabinet, and e) a front panel supported pivotally on the upper end of the towel rod support members for movement of said front panel between a retracted position substantially closing the open front side of said cabinet in the retracted position of said towel rod support members and an extended position hanging downwardly and forwardly of said open front side of said cabinet in the extended position of said towel rod support members.

2. The towel warmer and dryer cabinet of claim 1 wherein the cabinet bottom is open and a source of heated air current is mounted in the cabinet adjacent to and registering with said open bottom.

3. A towel warmer and dryer cabinet, comprising a) a hollow cabinet having an open front side and laterally spaced side walls, b) a pair of towel rod support members one positioned adjacent each of the lateral side walls of the cabinet for supporting therebetween a towel support rod adjacent the upper end of the open front side of said cabinet, c) at least one towel support rod extending between and supported by said towel rod support members adjacent the upper end of the open front side of said cabinet for hanging a towel vertically downward from said rod toward the bottom of said cabinet, and d) securing means integrally connecting said cabinet and said towel rod support members together and configured to enable movement of said at least one towel support rod through said open front side of the cabinet between a position retracted within the cabinet and a position extended forwardly of said open front side of the cabinet while maintaining the at least one towel support rod adjacent the upper end of the cabinet, wherein the securing means comprises pivot means interengaging the support members and cabinet adjacent the bottom end of the support members for moving said at least one towel support rod arcuately through said open front side of the cabinet between said retracted and extended positions.

4. The towel warmer and dryer cabinet of claim 3 including a front panel supported pivotally on the upper end of the towel rod support members for movement of said front panel between a retracted position substantially closing the open front side of said cabinet in the retracted position of said towel rod support members and an extended position hanging downwardly and forwardly of said open front side of said cabinet in the extended position of said towel rod support members.

5. The towel warmer of claim 3, wherein movement of the said at least one towel support rod is arcuate relative to the frame members.

* * * * *